US007980111B2

(12) United States Patent
Bishop

(10) Patent No.: US 7,980,111 B2
(45) Date of Patent: Jul. 19, 2011

(54) BENDING TOOL

(75) Inventor: Jeffrey C. Bishop, Derby (GB)

(73) Assignee: Rolls-Royce PLC, London (GB)

( * ) Notice: Subject to any disclaimer, the term of this patent is extended or adjusted under 35 U.S.C. 154(b) by 128 days.

(21) Appl. No.: 12/311,977

(22) PCT Filed: Oct. 19, 2007

(86) PCT No.: PCT/GB2007/003993

§ 371 (c)(1),
(2), (4) Date: Apr. 21, 2009

(87) PCT Pub. No.: WO2008/062152

PCT Pub. Date: May 29, 2008

(65) Prior Publication Data

US 2010/0024514 A1 Feb. 4, 2010

(30) Foreign Application Priority Data

Nov. 21, 2006 (GB) ..... 0623139.3

(51) Int. Cl.
*B21D 31/00* (2006.01)
*B21D 5/02* (2006.01)

(52) U.S. Cl. ..... 72/389.4; 72/388; 72/389.6; 72/396; 72/413

(58) Field of Classification Search ..... 72/12, 213, 72/383, 389.3–389.8, 387, 396, 413
See application file for complete search history.

(56) References Cited

U.S. PATENT DOCUMENTS

| | | | | |
|---|---|---|---|---|
| 2,433,841 | A * | 1/1948 | Glud | 72/396 |
| 3,209,576 | A * | 10/1965 | Giordano | 72/389.3 |
| 5,060,501 | A * | 10/1991 | Heath | 72/413 |
| 5,295,385 | A | 3/1994 | Murai | |
| 5,365,766 | A * | 11/1994 | Takahashi et al. | 72/387 |
| 5,878,619 | A * | 3/1999 | Walczak | 72/478 |
| 6,523,389 | B1 * | 2/2003 | Girdner | 72/413 |
| 6,651,471 | B1 * | 11/2003 | Gasparini | 72/389.3 |
| 6,672,127 | B2 * | 1/2004 | Maida | 72/389.4 |
| 6,715,334 | B2 * | 4/2004 | Kimura et al. | 72/389.8 |
| 7,117,711 | B2 * | 10/2006 | Feijen | 72/389.4 |
| 7,454,943 | B2 * | 11/2008 | Jacobsen | 72/389.8 |
| 7,584,640 | B1 * | 9/2009 | Liu et al. | 72/389.3 |
| 2007/0005176 | A1 | 1/2007 | Yamazaki et al. | |

FOREIGN PATENT DOCUMENTS

| | | |
|---|---|---|
| DE | 103 15 894 A1 | 10/2004 |
| EP | 1 066 893 A1 | 1/2001 |
| EP | 1 513 628 B1 | 8/2005 |
| JP | A-2006-122959 | 5/2006 |

* cited by examiner

*Primary Examiner* — David B Jones
(74) *Attorney, Agent, or Firm* — Oliff & Berridge, PLC

(57) ABSTRACT

It is difficult to bend materials for forming beyond 180° in terms of bend angle due to the entrant nature of prior press forming arrangements including a press tool with a press recess of a static nature. By providing a press recess which is formed from actuators allowed to dynamically shift about a deflection member it is possible as a press tool engages and forces a material to be formed into the press recess to envelope the press tool and therefore achieve greater than 180° bending angles. The actuators are formed in a stack with alternate left right presentation of shaped receiving apertures which include an actuator surface 34 engaged by the material to be formed in order to cause the necessary deflections during the pressing process.

14 Claims, 4 Drawing Sheets

BENDING TOOL

The present invention relates to bending tools and more particularly to bending tools utilised in a press forming arrangement in order to achieve bending and forming of typically sheet materials.

Press forming of components is a well known technique and a standard press brake tooling arrangement comprises an upper moving tool and a lower static tool. The upper tool is profiled to have a simple radius along its bottom edge with a top edge shaped to fit the clamping mechanism of a press tool such as a guillotine beam. The lower tool is shaped so that the bottom face interlocks with a robust mounting and is such that an upper forming face of the static lower tool presents typically a symmetrical open "V" centralised on the radius of the bottom of the upper tool. Thus, the lower tool is fixed to the base of the machine whilst the upper tool moves vertically up and down with the line of action of the centre of the nose radius bisecting the angle of the opening of the lower forming "V" in the press tool.

It will be appreciated that the materials formed by the above described press tool arrangement are generally of a sheet form and the desired angle of bends formed into the process can vary greatly. In order to create bends greater than 90° the minimum possible angle at the base of forming "V" is typically around 28°. This limits the bending angle capacity to no more than about 150° maximum dependent upon the spring back nature of the material to be formed. By use of special parallel sided tools it is possible to increase this limit beyond 150° but generally even then due to spring back of the formed material the maximum sustained bend angle will be less than 180°. It will be understood that 180° is also typically a maximum bend angle in view of the entrant nature of the upper tool engaging the lower tool.

DETAILED DESCRIPTION

Figure 1A:
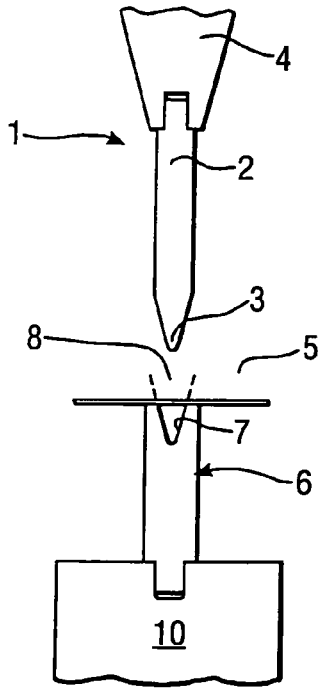
FIGS. 1*a-b* are front views illustrating a "V" press tool arrangement.
Figure 1B:
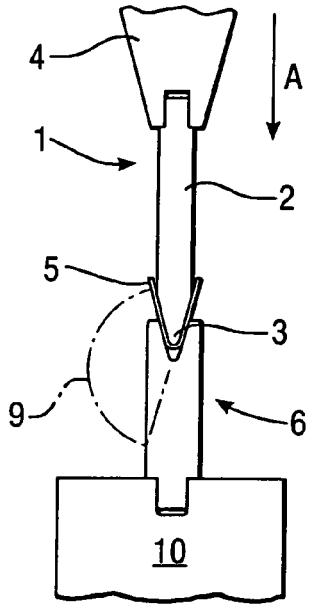

FIG. 1 illustrates a typical forming "V" press tool arrangement in a pre-form state in FIG. 1*a* and generally towards the end of the forming process in FIG. 1*b*. Thus, as can be seen, an upper moving tool 1 includes a profile 2 with a forming end 3. The profile 2 is secured upon a press beam 4 to engage a material such as a metal sheet. A press tool 6 is provided incorporating a forming profile 7 which, as indicated previously, is generally "V" shaped. The profile 7 as described above in the prior arrangement depicted in FIG. 1 typically has a minimum angle 8 of about 28° resulting in a maximum bending range of up to about 150° dependent upon material 5 spring back. The lower press tool 6 is static and secured to a robust base 7. FIG. 1*b* illustrates a situation where the sheet material 5 has been bent by the press tool arrangement. As can be seen, the sheet 5 is bent by a downward motion of the profile 2 in the direction of arrowhead A. As indicated, the bend angle 9 is typically limited by the "V" profile 7 created in the lower tool and entrant aspects with regard to the end 3 of the profile 2.

Figure 2A:
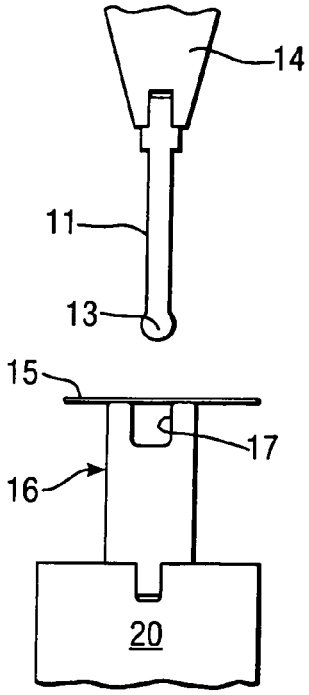
FIGS. 2*a-b* are front views illustrating an alternative parallel sided press tool.
Figure 2B:
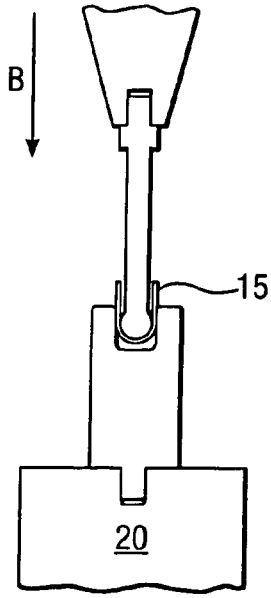

In order to approach 180° bend angles as depicted in FIG. 2 an alternative parallel sided press tool is used. This tool has a substantially zero degree "V" aperture profile 17 in a lower tool 16. In other respects the arrangement is similar to that depicted in FIG. 1. Thus, the lower tool 16 is secured to a robust base to present the aperture 17 to a material in the form of a sheet 15 to be formed by the process. An upper tool profile 11 is secured to a press beam 14 such that a forming end 13 engages the material 15 and bends that material into the aperture 17. In such circumstances as depicted in the formed state by FIG. 2*b* it will be noted that the material 15 is bent to substantially adopt a 180° turn by pressing action of the upper moving tool formed by the profile 11 moving in the direction of arrowhead B in the aperture profile 17. Nevertheless, it will be appreciated it is necessary for the end 13 and the profile 11 to be removed from the formed material 15 and therefore there is a limitation upon the bend angle achievable. The final bend achievable will be further diminished typically by the spring back nature of press formed materials particularly when cold formed.

In view of the above it will be appreciated that achievement of bend angles approaching and exceeding 180° is difficult with prior press tool arrangements.

In accordance with aspects of the present invention there is provided a bending tool comprising a press recess to receive a material for forming, the tool characterised in that the press recess is formed by a plurality of actuators having a respective shaped receiving aperture and supported upon a deflector, these shaped receiving apertures in adjacent actuators alternatively slanted to define a recess opening for the material to be formed, the actuators deflectable about the respective deflector to receive the material to be formed upon pressing about the receiving opening to form the press recess.

Typically, edges of the shaped receiving aperture have a low friction feature. Possibly, the low friction feature comprises a roller. Generally, the low friction feature comprises a bearing surface for the material to be formed.

Generally, the deflector comprises a spring bias to a pre-press configuration.

Typically, the shaped receiving apertures have a rounded bottom.

Generally, the shaped receiving apertures have an actuator ramp below the receiving opening.

Typically, the shaped receiving apertures in adjacent actuators slant alternately left and right.

Generally, the shaped receiving apertures are symmetrical about the receiving opening.

Typically, the actuators abut each other. Alternatively, the actuators have a space between each other. Possibly, the space between actuators includes an anti buckle feature for the actuator in use.

Typically, the shaped receiving apertures are arranged to define a virtual "V" between a bottom overlap junction and side edges of the aperture. Possibly, the side edges incorporate the low friction feature as described above.

Also in accordance with aspects of the present invention there is provided a bending tool as described above and a press tool to press a material to be formed into the recess opening.

Typically, the press tool is tear drop shaped.

Generally, the actuators are arranged to embrace the press tool through the material to be formed to facilitate a greater than 180° bend in the material to be formed.

Generally, the actuators are aligned along an axis consistent with the principal axis of a press tool. Generally, the actuators bend about the deflection member relative to the principal axis.

Figure 3:
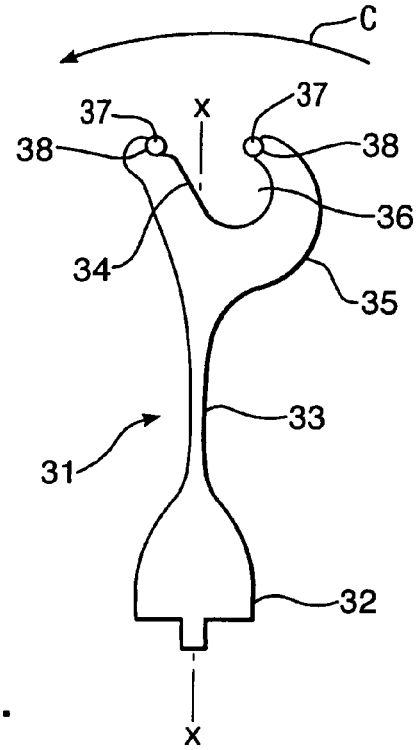
FIG. 3 is a front view illustrating an actuator in accordance with aspects of the present invention.

Embodiments of the present invention will now be described by way of example and with reference to the accompanying drawings in which:

FIG. 3 is a front view of an actuator in accordance with aspects of the present invention; and, FIG. 4 is a pictographic depiction of a press forming process with a press forming arrangement in accordance with aspects of the present invention.

Figure 5:
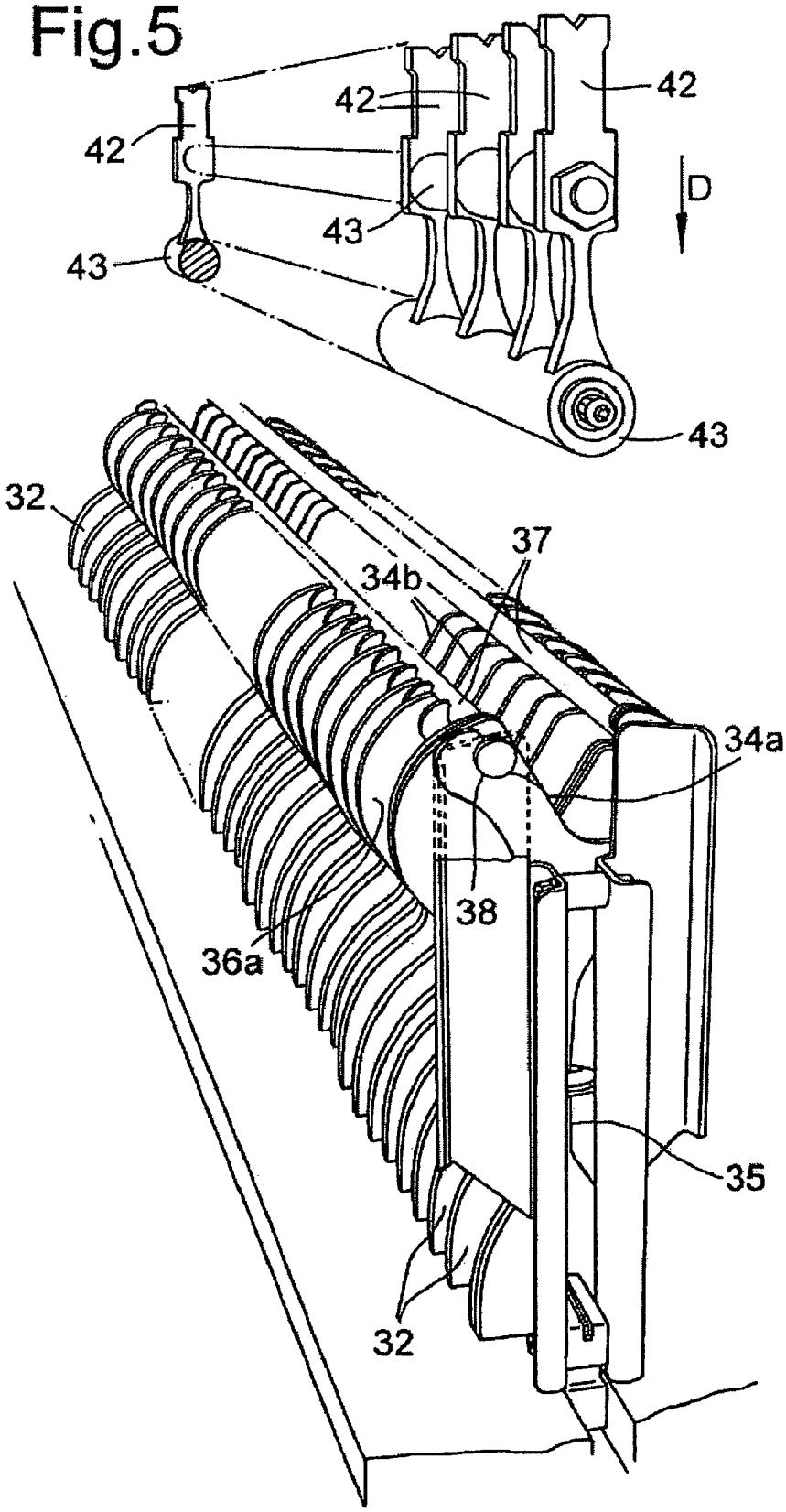
FIG. 5 is a perspective view of a bending tool arrangement in accordance with the present disclosure.

FIG. 5 is a perspective view of a bending tool arrangement in accordance with the present disclosure.

As indicated above it is difficult to bend material such as sheet materials with a bend angle beyond or even approaching 180° in view of the constraints of prior press tooling arrangements as well as with regard to the entrant nature of the press tool engaging a bending tool in operation. A principal problem relates to the static nature of the lower tool which generally incorporates a press recess within which a press tool operates in order to bend the material to be formed. By aspects of the present invention dynamic components are utilised in order to interact with the downward progress of an upper press tool in operation. In accordance with aspects of the present invention a number of actuator elements are utilised in order to define a press recess within which material is formed. By such an approach the dynamic movement of the actuators provides a capability to bend a material to be formed through elastic deformation into the desired shape. The actuators are elastically deformed themselves during the press forming process but at other times are relatively fixed components.

FIG. 3 illustrates a typical actuator component in accordance with aspects of the present invention. The actuator 31 comprises a base 32 which enables the actuator to be secured to a robust mounting. Extending from the base 32 is a deflector member 33 in the form of a beam spring. Extending from the deflector member 33 is an actuator head including an actuator surface 34 and a drive arm 35 to define a shaped receiving aperture 36. As will be described later, typically edges of the shaped receiving aperture 36 will have a low friction bearing function. In such circumstances as depicted in FIG. 3 in the arrangement rollers 37 are provided on roller seats 38. The rollers 37 will be axially continuous in an assembly of actuators 31 in a bending tool in accordance with aspects of the present invention. It will be appreciated that these rollers 37 will be driven by the action of engagement with a material to be formed in use respectively in clockwise and anti clockwise directions to envelope the material as it is shaped and formed.

As indicated above, a number of actuators 31 will be assembled to form a bending tool in accordance with aspects of the present invention. These actuators 31 will be arranged such that a slant angle for the respective shaped receiving apertures will alternate in opposite directions. The actuator 31 depicted in FIG. 3 is of a left hand nature and adjacent actuators in a bending tool in accordance with aspects of the present invention will have an opposite right hand slant. In such circumstances respective adjacent actuators will have a reversed pair in relation to each other. In use it will be appreciated that the actuator will be rotated by the engagement action with the material to be formed. With regard to the left hand actuator 31 depicted in FIG. 3 this rotation will be in the direction of arrowhead C. This rotation and deflection will be accommodated by the deflector member 33. It will be understood that this deflection is as a result of abutment and contact by the material, that is to say the work piece in engagement with the actuator slope 34.

Each actuator 31 is typically formed from a sheet material. As indicated, this sheet material will be cut to define the elements of the actuator and in particular the base 32, the deflection member 33 and the actuator head including an aperture 36 as depicted in FIG. 3. The size and general configuration of each actuator 31 will be arranged such that there is an appropriate deflection response by the deflection member 33 and the aperture 36 is sized to define a press recess in use. The respective actuator surfaces 34 in adjacent actuators 31 will cross at an intermediate position to define an actuator surface junction. The edges incorporating rollers 38 or other non friction surfaces for bearing of the material to be formed will define other points in a general virtual forming "V" press recess. This recess will be adjusted as the material to be formed is pressed into the press recess opening defined by the adjacent apertures 36. As indicated above, the actuator heads in adjacent actuators will be deflected as result of the pressing action and through engagement with the surfaces 34 such that with left hand actuators there will be displacement in the direction of arrowhead C whilst right hand actuators either side of the actuator as depicted in FIG. 3 will be deflected in the opposite direction to arrowhead C. In such circumstances the apertures 36 will envelop a press tool in order to bend and form about the material to be formed.

As indicated, the actuators 31 are generally left hand or right hand and it will be appreciated in such circumstances the actuators formed will be substantially the same but alternately configured along the axial length of the bending tool in accordance with aspects of the present invention. In such circumstances the apertures 36 and deformation members 33 will mirror each other along a principal axis X-X. Deflection will be either side of the principal axis X-X and generally the actuator surface 34 junction, that is to say the apertures 36 also overlap along the principal axis X-X.

In use it will be appreciated that the stack of actuators will have sufficient axial length to provide the desired bending of the material to be formed. Normally, the axial length of the bending tool will be longer than the width of the work piece. In terms of the axial density, that is to say the number of actuators per unit length, this may be varied dependent upon the expected magnitude of workloads presented during the press forming process. Actuators may abut each other with appropriate lubrication to allow flexing and bending as indicated about the deformation member 33. Alternatively the actuators 31 may be spaced relative to each other where workloads allow. In such circumstances the actuators 31 will not form a continuous stack but will have gaps and spaces between actuators along the axial length of the bending tool. Where spaces are provided it will normally be necessary to provide an anti buckling device at least in the region of the deformation member 33.

It will be understood that the deformation member 33 will typically incorporate a bias force to return the actuator to its initial pre pressing configuration relative to the principal axis X-X. This bias force will create the necessary forming pressures through the drive arm 35 to engage and envelope a press tool to achieve bending of the material to be formed beyond a 180° bending angle.

FIG. 4 illustrates a typical sequence with regard to achieving bending of a work piece material to be formed beyond a 180° bending angle. Consistent nomenclature has been transposed from previous FIG. 3 for comparison and clarity.

Figure 4A:
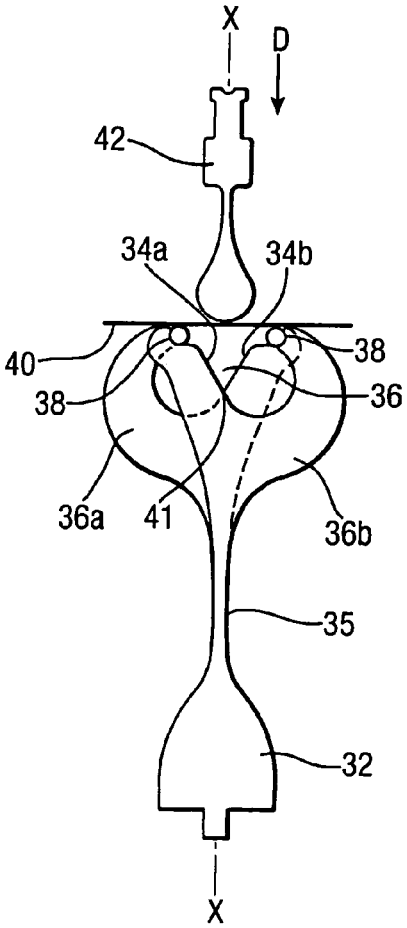
FIGS. 4*a-e* are front pictographic depictions of a press forming process with a press forming arrangement in accordance with aspects of the present invention.

FIG. 4*a* illustrates press forming arrangements in accordance with aspects of the present invention just prior to a press forming. Thus, as can be seen, a material 40 generally in the form of a sheet is located above a receiving opening defined between edges of shaped receiving apertures 36 in respective adjacent actuators. These actuators are stacked alternately left hand and right hand as described previously such that the actuator surfaces 34*a*, 34*b* define a "V" about a junction 41 between the surfaces 34*a*, 34*b* and upper bearing edges 37. In use a press tool 42, is arranged to move in the direction of arrowhead D to descend initially into contact with the material to be formed 40 and then to bend that material 40 into the "V" formed virtual press recess between the junction 41 and the edges 37. This descent in the direction of arrowhead D is initially depicted in FIG. 4*b*.

Figure 4B:
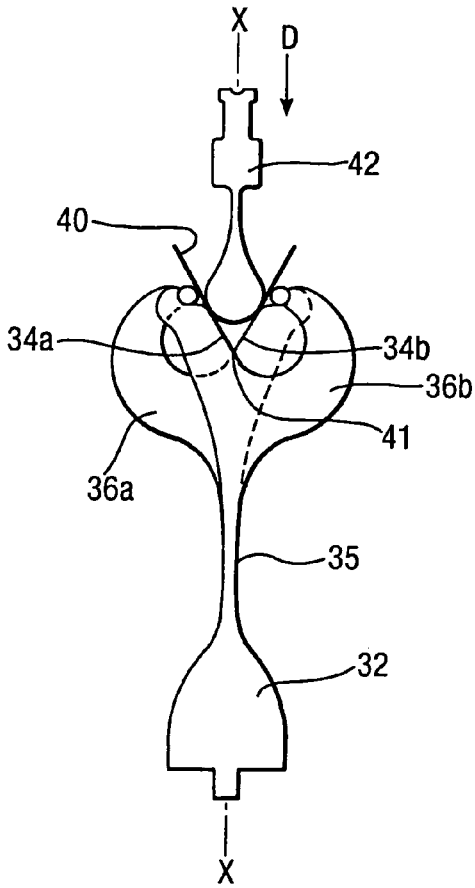

In FIG. 4*b* the material to be formed 40 is initially bent until there is engagement between this material and the actuator surfaces 34*a*, 34*b*. This is the initial bending and formation of the material 40.

Figure 4C:
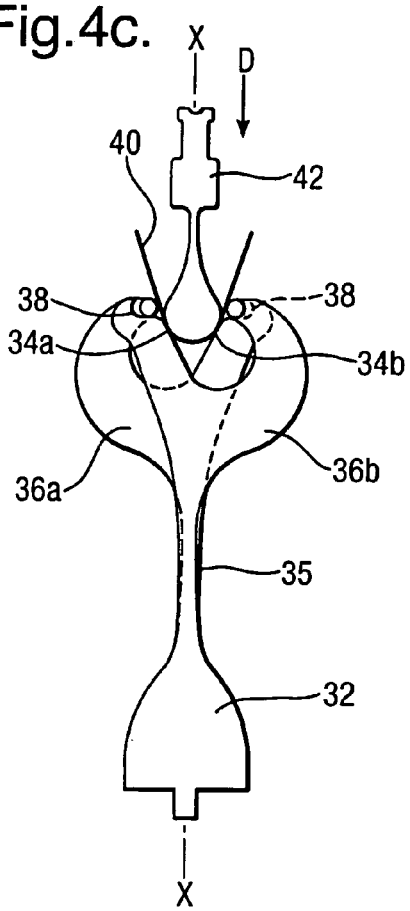
Figure 4D:
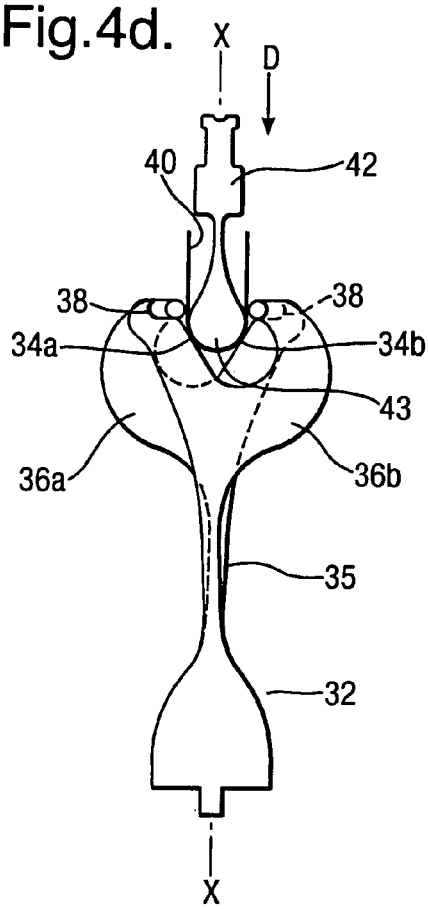

In FIG. 4*c* further downward movement of the press tool 42 forces the actuator surfaces 34*a*, 34*b* apart and so adjusts the distance between the edges 37 to accommodate deflection and bend forming of the material 40.

As the tool 42 descends further in the direction of arrowhead D the separation of the actuator surfaces 34*a* is arranged to allow the edges 38 to wrap around a teardrop or bulbous shaped end 43 of the tool 42. In such circumstances the material 40 begins to bend beyond a 180° bend angle.

Figure 4E:
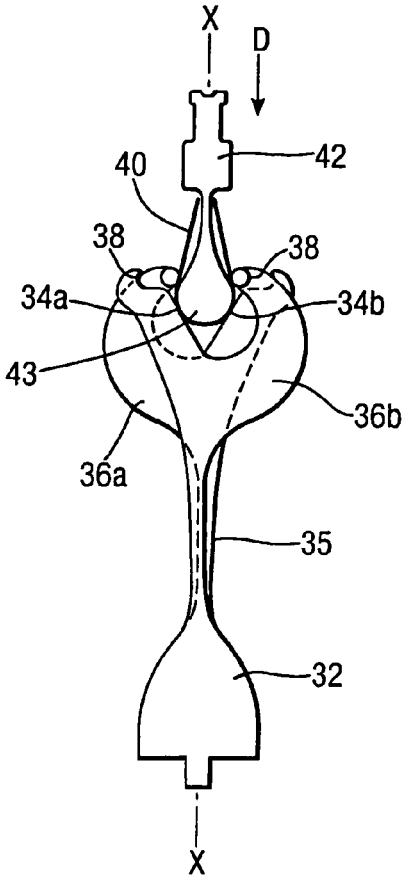

In FIG. 4*e* further descent of the tool 42 in the direction of arrowhead D causes further bending of the material 40 to be formed to a desired bend angle. Again the edges 37 wrap around the end 43 of the tool 42 to achieve this bend angle.

It will be appreciated once the press tool 42 has achieved the desired bend penetration, that is to say bending of the material 40, its motion is typically immediately reversed. In such circumstances due to the nature of spring back, the tool 42 can be removed from the material 40. Alternatively, when the tool 24 is reversed, that is to say is lifted in the opposite direction of arrowhead D the actuators in accordance with aspects of the present invention will recover their original pre press configuration and automatically release/eject the material 40 now bent and press formed to a desired shape. If the degree of permanent bend in the material 40 is greater than 180° it will be appreciated that the material 40 then remains attached to the tool end 43. In this situation typically the material as a formed work piece will be slid sideways off the end 43. Once the work piece has been removed it will be appreciated that the arrangement as outlined in FIG. 4 is ready for a repeat process with further material 40.

It will be appreciated by aspects of the present invention that it is possible to form material with a bend angle greater than 180° in a single controlled operation. Thus, it is not necessary to utilise prior art unreliable and practically limited forming techniques. The actuators as indicated, are typically formed from sheet material and designed and manufactured by cutting, possibly through a laser cutting process, appropriate shapes. The deformation members 35 will typically be arranged to provide sufficient force for movement of the actuator heads and in particular the ends 37 about the press tool 42 to define the bending action. Aspects of the present invention allow a forming arrangement which can achieve greater than 180° magnitude bend processes which will allow an actual bend approaching 180° when taken into account high spring back qualities of the material to be formed such as titanium. By provision of a single press tool action prior multi operational staged processes are eliminated. Furthermore, component quality is enhanced through the use of a single operation as a cold process rather than prior multi staged or high temperature processing techniques. It will be understood in use typically the arrangement will be combined with an automatic feed process for delivery of the material 40 to be formed.

As indicated above, it is important that the edges 37 of the actuators have a bearing feature as these will engage the material 40 to be formed. Although other techniques will be used it is most convenient if rollers are provided at the edges 37 to allow the bearing function as well as allowing the edges 37 to conveniently wrap around the press tool 42.

As can be seen, the actuator surfaces are generally relatively straight to engage the material and cause deflection of the press recess in use. Other parts of the shaped recess aperture are generally round bottomed to avoid impingement with the work material.

Normally, the actuator surfaces 34 are arranged to be directly below a receiving opening defined between the edges 38 in order that the actuator surface will engage the material as a work piece in use to cause the desired initial deformation and then wrap around of the edges to achieve the desired opening action.

It will be understood that the actuators 31 as indicated, are located together in a stack. If rollers are used these will extend from roller seats at the edges 38 in each actuator along the axial length of the bend tool formed by a stack of actuators in accordance with aspects of the present invention. However, the rollers will not integrate the actuators together and generally, as indicated above, a base 32 will be provided for each actuator to allow the actuator to be mounted in a robust surface. Other means for association of the actuators may also be provided.

As indicated above it is engagement by the material to be formed with the actuator surface or ramp which causes deflection of the edges 38 in order to envelope the press tool with the material between the anvil effectively forced by the actuator surfaces 34 and the press tool. In such circumstances specific shaping, sizing and configuration of the shaped receiving aperture 36 will be chosen to achieved the desired engagement for such deflection about the deflection member 33 as well as to constitute an appropriate press recess in accordance with aspects of the present invention. Each individual actuator will generally be formed from a sheet material which will normally be a metal but in certain circumstances, and where the material to be formed will not present significant loads, it may be possible to form the actuators from a plastics material or to reinforce or stiffen parts of the shaped receiving aperture appropriately.

Alterations and modifications to aspects of the present invention as described above will be understood by those skilled in the technology. In such circumstances, as indicated, the edges 38 are provided with rollers in order to allow slide bearing as the material to be formed is pressed into the press recess formed by the shaped receiving apertures 36. These rollers, as indicated, are there to generally allow the material to move relative to these edges 38 and therefore may be replaced by other low friction bearing surfaces such as a plastics material.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A bending tool arrangement for bending a sheet material, comprising:

a plurality of actuators, comprising:

a base;

an actuator head having an actuator surface and a drive arm that define an aperture; and a deflector member configured to allow deflection of the actuator head with respect to the base, the deflector member being disposed between the actuator head and the base; and a press tool insertable into the aperture and engageable with the actuator surface to deflect the deflector member and rotate the drive arm.

2. A tool as claimed in claim 1 wherein an edge of the aperture has minimal friction.

3. A tool as claimed in claim 1 wherein the deflector member comprises a spring bias for reconfiguring the tool to a configuration before the press tool is inserted into the aperture.

4. A tool as claimed in claim 1 wherein the aperture has a rounded bottom.

5. A tool as claimed in claim 1 wherein the aperture has an actuator ramp below a receiving opening.

6. A tool as claimed in claim 1 wherein the plurality of actuators are adjacent to one another and the apertures of adjacent actuators slant alternately left and right.

7. A tool as claimed in claim 6 wherein the apertures are symmetrical about a receiving opening.

8. A tool as claimed in claim 7 wherein a space between actuators includes an anti buckling device for an actuator in use.

9. A tool as claimed in claim 6 wherein the apertures are configured to allow a less than 180° bend in the sheet material to be formed.

10. A tool as claimed in claim 9 wherein side edges incorporate minimal friction.

11. An arrangement as claimed in claim 1 wherein the press tool is tear drop shaped.

12. An arrangement as claimed in claim 1 wherein the actuators are configured to allow a greater than 180° bend in the sheet material to be formed.

13. An arrangement as claimed in claim 1 wherein the plurality of actuators are aligned along an axis consistent with a principle axis of the press tool.

14. An arrangement as claimed in claim 13 wherein the plurality of actuators form a bend about the deflector member relative to a principle axis.

* * * * *